US005111172A

United States Patent [19]

Laskaris

[11] Patent Number: 5,111,172

[45] Date of Patent: May 5, 1992

[54] DEMOUNTABLE COIL FORM FOR EPOXY-IMPREGNATED COILS

[75] Inventor: Evangelos T. Laskaris, Schenectady, N.Y.

[73] Assignee: General Electric Company, Schenectady, N.Y.

[21] Appl. No.: 395,634

[22] Filed: Aug. 17, 1989

[51] Int. Cl.[5] ..... H01F 7/22

[52] U.S. Cl. ..... 335/216; 335/299; 242/7.07

[58] Field of Search ..... 335/216, 299; 336/DIG. 1; 174/125.1; 242/7.07

[56] References Cited

U.S. PATENT DOCUMENTS

| | | | |
|---|---|---|---|
| 3,559,128 | 1/1971 | Kingston et al. | 335/216 |
| 3,613,006 | 10/1971 | Kantdowitz et al. | 335/216 |
| 4,727,346 | 2/1988 | Westphal et al. | 335/216 |
| 4,978,936 | 12/1990 | Markiewicz et al. | 335/216 |

*Primary Examiner*—Geroge Harris

*Attorney, Agent, or Firm*—James R. McDaniel; James C. Davis, Jr.; Paul R. Webb, II

[57] ABSTRACT

A demountable coil form for fabricating epoxy impregnated superconductive coils having a split ring and a collar clamp secured to the ring on either side of an axially extending opening for adjusting the size of the ring opening. The axially extending opening is widest at its inner diameter and tapers towards the outer diameter of the ring. Cap screws in contact with a wedge and connected to the ring are provided for securing the wedge in the opening in the ring. The wedge has a taper matching the taper of the opening in the ring and is positioned flush with the outer diameter of the ring. Annular side plates are secured to either axial side of the ring, with the side plates extending radially outwardly from the ring. The side plates define slots which create a passageway from the exterior of the side plates to the interior.

6 Claims, 5 Drawing Sheets

DEMOUNTABLE COIL FORM FOR EPOXY-IMPREGNATED COILS

CROSS REFERENCE TO RELATED APPLICATIONS

The present invention is related to the following copending applications: Ser. No. 395,635, entitled "Epoxy-Impregnated Superconductive Tape Coils" and Ser. No. 395,636 entitled "Magnet Cartridge for Magnetic Resonance Magnet" and Ser. No. 395,637 now U.S. Pat. No. 4,986,078 entitled "Refrigerated MR Magnet Support System".

BACKGROUND OF THE INVENTION

The present invention relates to reusable coil forms for winding superconductive coils and epoxy impregnating them.

Conventional coil forms for superconductive coils are made of a solid ring with bolted on side plates. The coil is wound on the outer diameter of the ring. To release the coil after it has been epoxy impregnated from the coil form, the side plates are removed and the solid ring is cooled rapidly with liquid nitrogen to cause the ring to shrink away from the coil. For long slender coils, rapid cooling may not be successful because the coil may cool at nearly the same rate as the ring, making removal of the coil difficult. It is an object of the present invention to provide a reusable coil form that can be easily released from the superconductive coil after the coil has been impregnated with epoxy resin

SUMMARY OF THE INVENTION

In one aspect of the present invention, a demountable coil form for fabricating an epoxy impregnated superconductive coil having a split ring and a collar clamp secured to the ring on either side of the axially extending opening for adjusting the size of the ring opening. The split ring has an axially extending opening which is widest at its inner diameter and tapers towards the outer diameter of the ring. Means in contact with a wedge and connected to the ring are provided for securing the wedge in the opening in the ring. The wedge has a taper matching the taper of the opening in the ring and is positioned flush with the outer diameter of the ring. Annular side plates are secured to either axial side of the ring, with the side plates extending radially outwardly from the ring. The side plates define slots which create a passageway from the exterior of the side panels to the interior.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with the accompanying drawing figures in which:

FIG. 4A is a composite view looking towards the insert and the wedge.

DETAILED DESCRIPTION OF THE INVENTION

Figure 1:
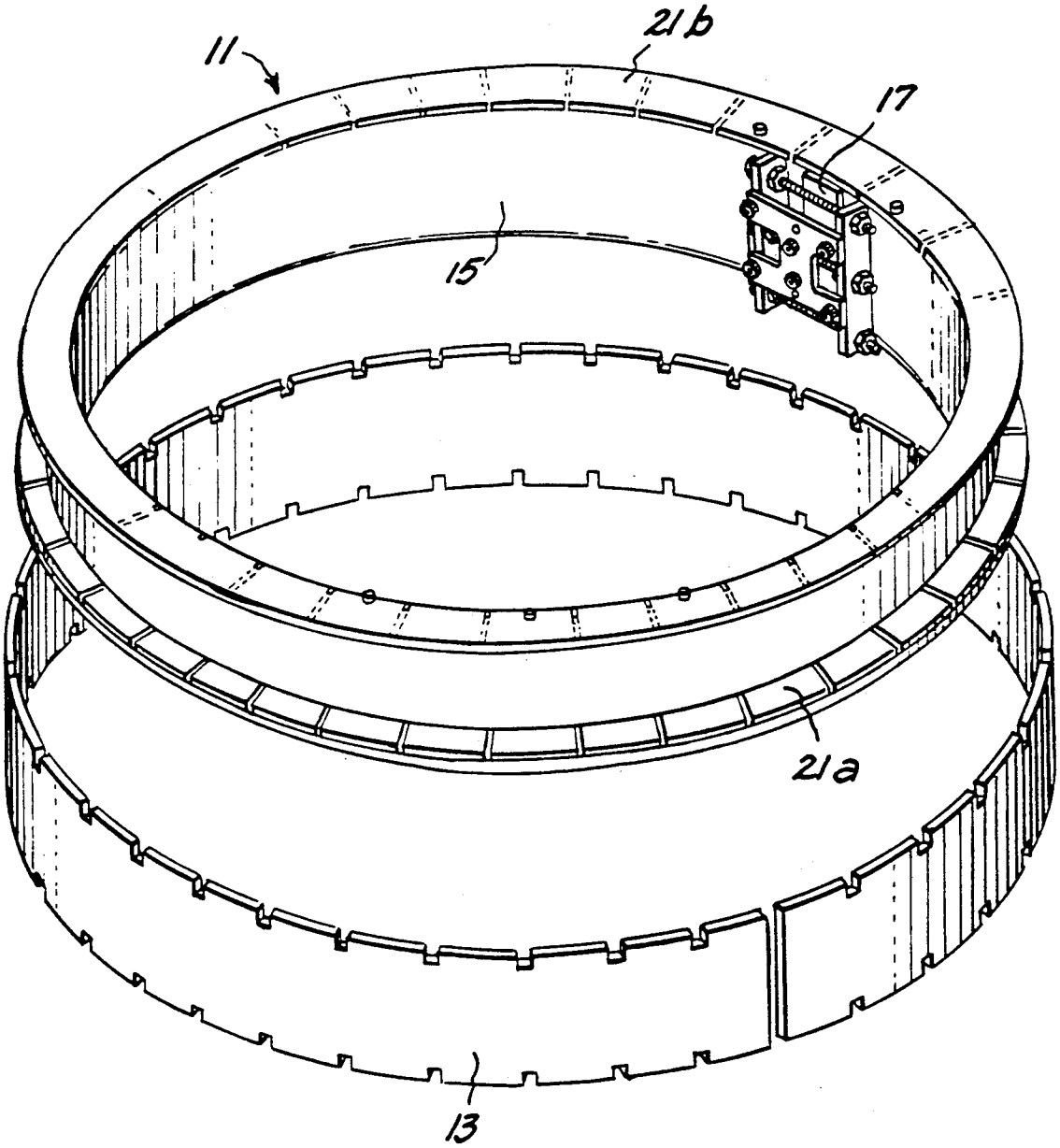
FIG. 1 is an exploded isometric view of a demountable coil form for fabricating epoxy-impregnated superconductive coils in accordance with the present invention.
Figure 2:
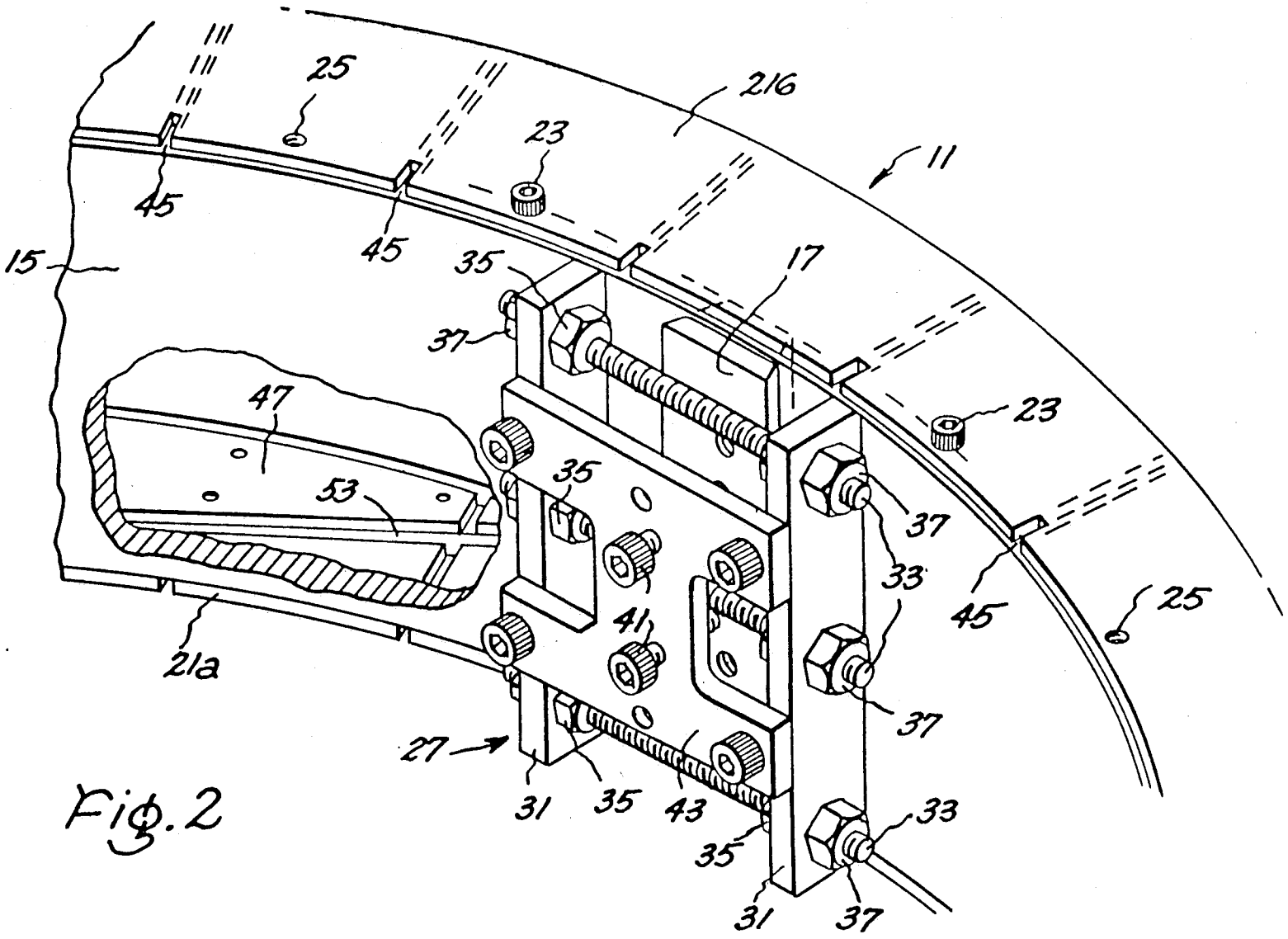
FIG. 2 is an enlarged portion of FIG. 1 showing a collar clamp and wedge secured to a split ring and cutaway showing an insert in one of the side plates.

Referring now to the drawing and particularly. FIGS. 1 and 2 thereof a coil form comprising a bobbin 11 and a split overwrap ring 13 are shown. The bobbin comprises a split ring 15, a wedge 17, and two annular disc shaped side plates 21*a* and 21*b*. The edges of the ring 15 are rabbeted (which can be seen in FIGS. 4A and 4B) providing a recess for the inner diameter of the annular disc shaped side plates 21*a* and 21*b*. The opening in the split ring 15 extends axially and is tapered, widening from the outer diameter to the inner diameter. The taper of the wedge 17 corresponds to the taper in the split ring 15 opening. With the wedge 17 in place in the opening the leading edge of the wedge lies on the outer circumference of ring 15. The wedge causes the ring to expand and the side plates 21*a* and 21*b* to contact the axially extending edge left after the rabbeting has occurred. The annular side plates are bolted to the axial edges of the rings with axially extending circumferentially spaced bolts 23. A number of jacking holes 25 which comprise threaded holes in the side plates are provided on the same diameter circle as the bolt holes for bolts 23.

A collar clamp 27 adjusts the size of the opening of the ring in the circumferential direction. The collar clamp comprises two blocks 31, three threaded rods 33 and inner and outer nuts 35 and 37, respectively. The blocks are welded to the inner ring surface on either side of the opening. The wedge 17 is positioned in the opening of the ring by two cap screws 41 extending from a threaded holes in a plate 43. Plate 43 is secured to blocks 31 through elongated holes in plate 43 allowing for adjustment in the size of the opening in the split ring. The outer nuts 37 (with the inner nuts 35 moved towards the center and out of the contact with the blocks) close the opening, clamping on the wedge. The inner nuts 35 (with the outer nuts 37 loosened) can be used to widen the opening. Plate 43 has two unthreaded openings which align with threaded holes in the wedge. Bolts placed in these holes in the plate and threaded in the wedge can be used to extract the wedge after the bolts 41 have been removed.

Figure 3:
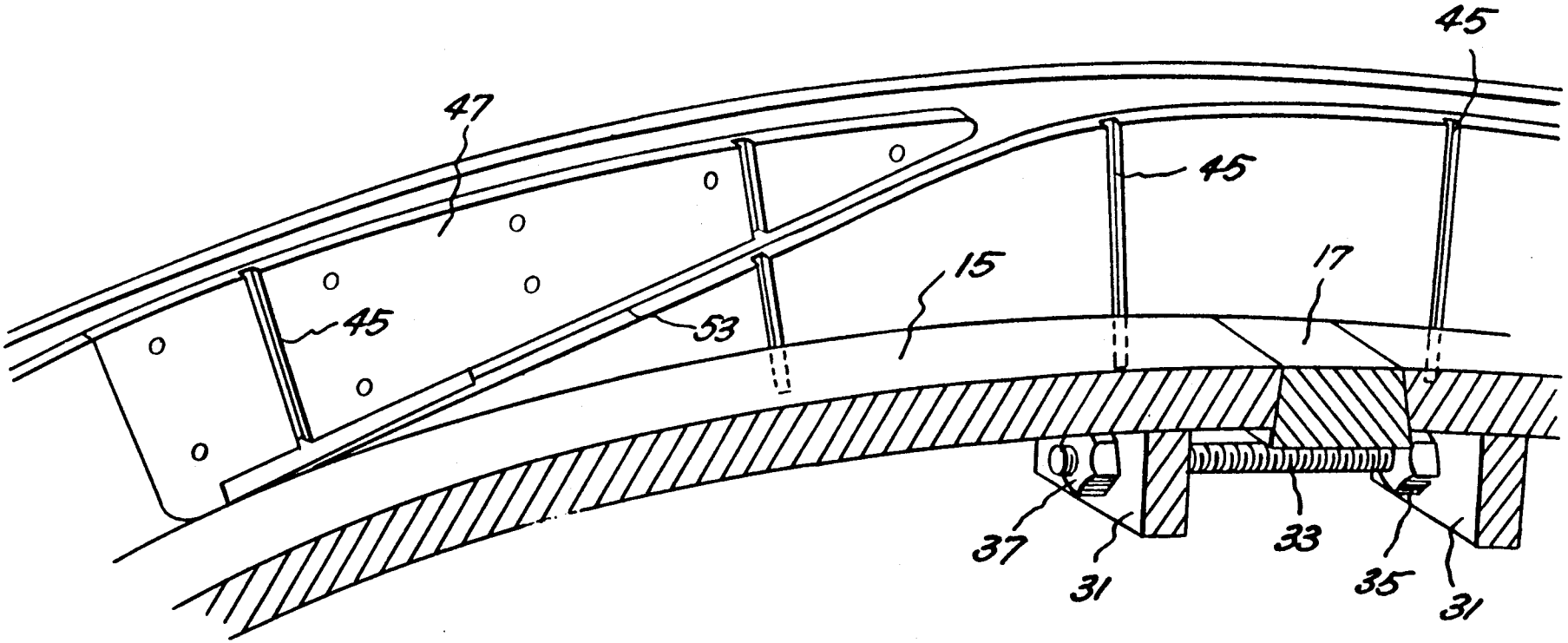
FIG. 3 is a partial sectional cutaway view of FIG. 1 showing the insert in one of the side plates.

Referring now to FIGS. 2 and 3, the side plates 21*a* and 21*b* each have on their inner face circumferentially spaced radially extending slots 45 which also extend in the axial direction on the inner circumference of the annular side plates. Side plate 21*a* has a generally right triangular recess in the inner wall with the hypotenuse extending tangentially from the ring portion adjacent the side wall outwardly. The right angle of the triangular recess is situated radially outwardly from the hypotenuse. An insert 47 having a shape corresponding the shape of the recess is secured in the recess using screws 51 which extend from the outside of the panel (see FIG.

4A). A portion of the insert 47 along the hypotenuse is machined away providing a groove 53 which decreases in depth at the lower edge of the insert until it is flush with the unrecessed portion.

The split ring 15, collar clamp 27, wedge 17, and side panels 21*a* and 21*b* can be fabricated from stainless steel, for example. The triangular insert can be fabricated from polytetrafluoroethylene. The split ring 15 can be formed by rolling a strip of material having a thickness greater than the thickness of the finished part into a split ring. The collar clamp 27 is secured to the ring and the wedge 17 is secured in place. The outer diameter of the ring and wedge are machined together to achieve the desired final diameter assuring the concentricity of the ring and proper fit of the wedge.

Figure 4A:
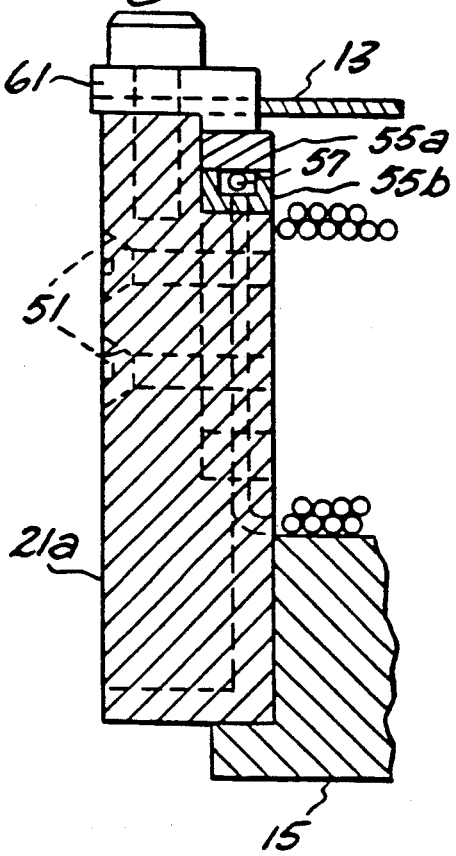
FIGS. 4A and B are partial cross sectional views of the coil form with the winding and overwrap split ring in place but before impregnation.
Figure 4B:
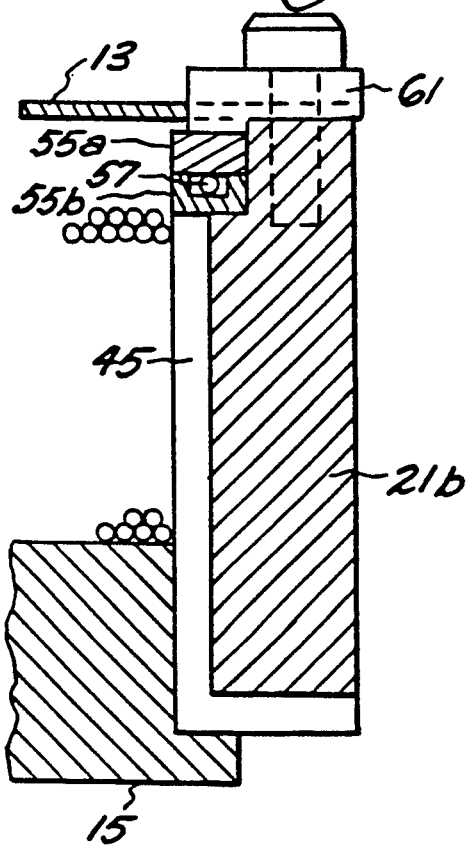
FIG. 4B is taken through one of the radially extending slots.
Figure 5:
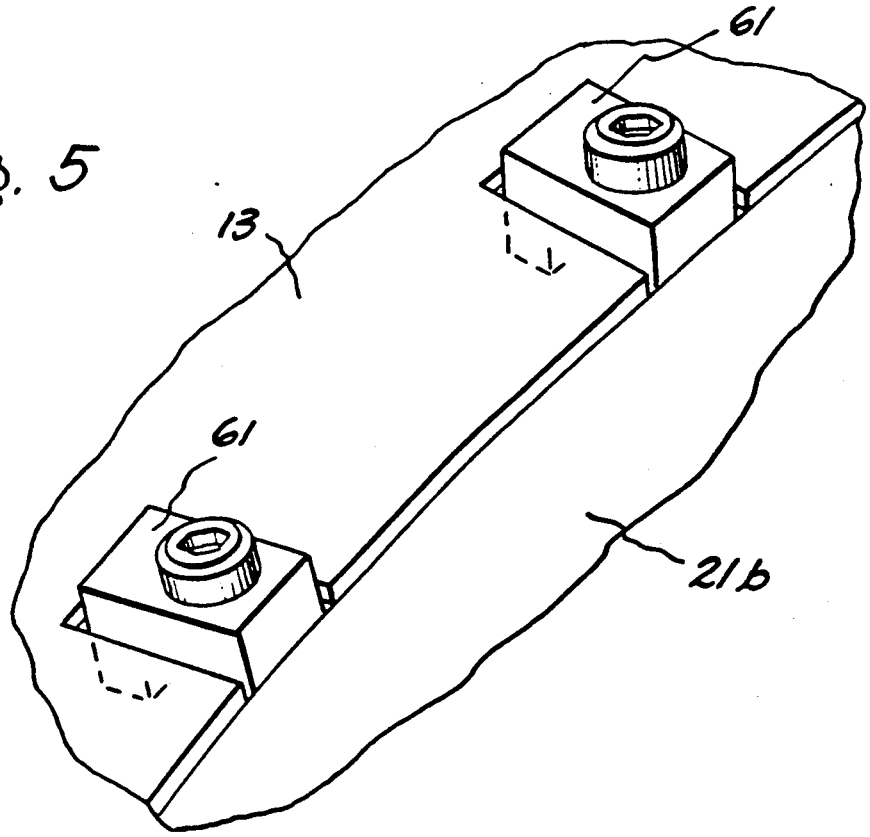
FIG. 5 is a partial isometric view showing the clamps of FIG. 4B holding the overwrap split ring in place.
Figure 6:
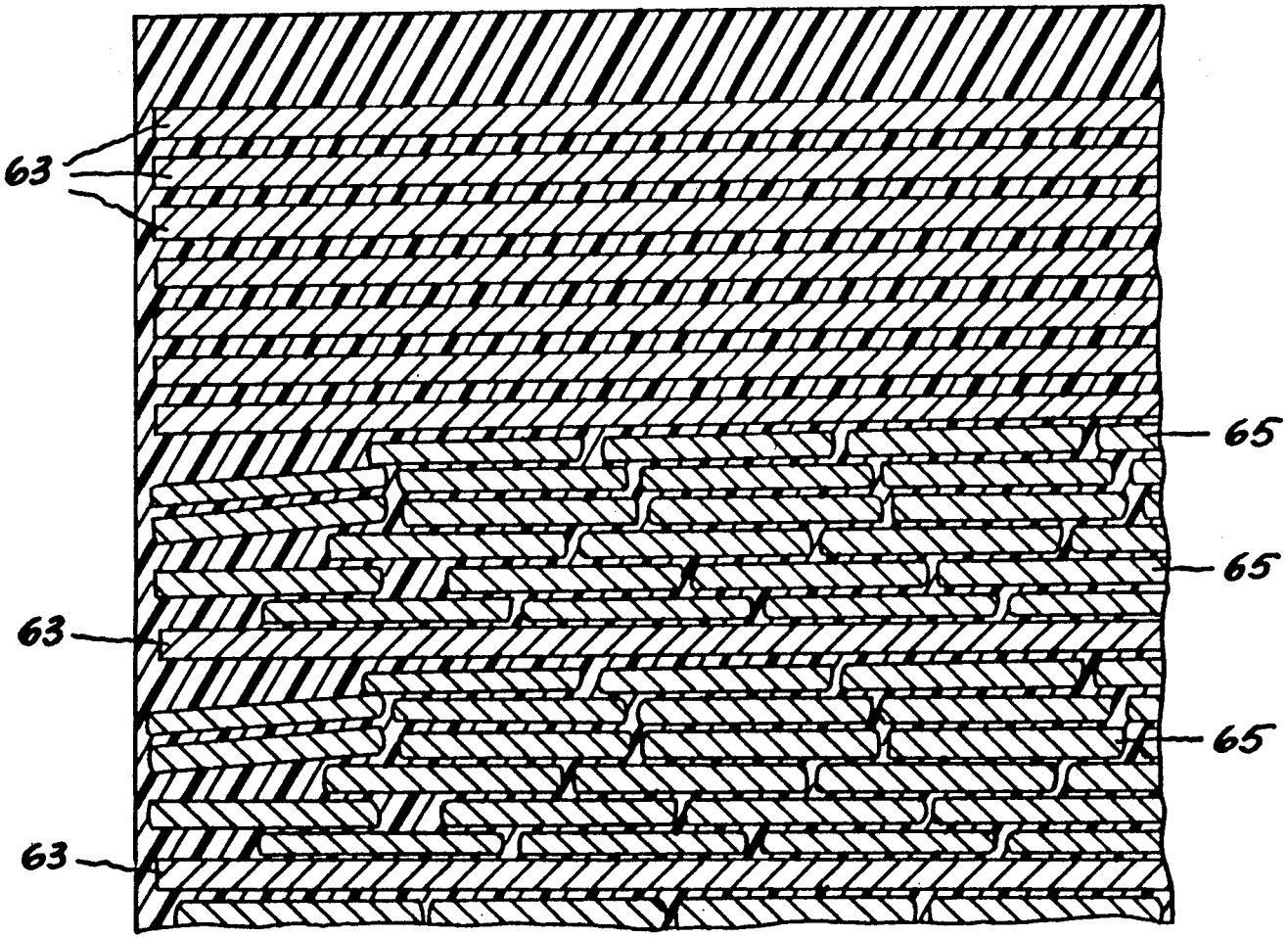
FIG. 6 is a partial sectional view of an epoxy impregnated superconductive tape coil removed from the coil form.

Referring now to FIGS. 4A and 4B, superconductive windings, which can be either superconductive tape or wire, have one end situated between two copper strips 55*a* and 55*b*. FIGS. 4*a* and 4B show a superconductive wire 57. The interior of strip 55*b* is machined to receive the conductor. The upper and lower halves of the strips can be soldered together using indium solder, for example. The strips are secured using clamps 61 in a groove formed in the inner side of the periphery of the side plates. The strips are treated with a releasing agent as in the interior surfaces of the form. The conductor sandwiched between the strips extends in the tangential groove 53 and is wrapped with fiberglass cloth. The interior of the coil form is covered with a layer of fiberglass cloth. The conductor without the strips 55*a* and 55*b* is wound on the form. The last turn shown in FIG. 4B is again sandwiched between copper strips 55*a* and 55*b* which are secured in a groove on the inside face of the periphery of side plate 21*b* between adjacent layers a preferably perforated copper loop surrounds the windings as well as additional loops around the completed winding. This can be seen in the cross section of the completed superconductive winding wound with tape 65 shown in FIG. 6. Additional layers of cloth can be added around the windings when the windings have been completed. As shown in FIG. 5, a flexible strip of stainless steel coated with release agent encloses the windings in the coil form. The coil form is placed in a pan and vacuum epoxy impregnated using an epoxy with a low viscosity at processing temperatures and a low pot life. A suitable epoxy resin formulation is described and claimed in copending application Ser. No 395,635. The epoxy resin covers the coil form with the epoxy entering the coil form through the slots 45 which extend axially through the side plates and between the stainless steel cover and the outer periphery of the side panels which do not form a perfect seal.

After pressure cycling to remove air bubbles and subsequent curing, the clamps are removed and the screws 51 holding the triangular insert 47 are taken out. The side panels 21*a* and 21*b* are both removed and bolts placed in the jacking holes to prey the side panels off. The triangular insert is then removed The collar clamp is loosened and the wedge removed using bolts in threaded holes in the wedge if necessary. The opening in split ring can be reduced by the collar clamp to provide easy removable of the coil from the ring.

The foregoing has described a reasonable coil form that can be easily released from the superconductive coil after the coil has been impregnated with epoxy resin.

While the invention has been particularly shown and described with reference to an embodiment thereof, it will be understood by those skilled in the art that various changes in form and detail may be made without departing from the spirit and scope of the invention.

What is claimed is:

1. A demountable coil form for fabricating epoxy impregnated superconductive coils comprising:

a split ring having an axially extending opening being widest at its inner diameter and tapering towards the outer diameter of the ring;

a collar clamp secured to the ring on either side of the axially extending opening for adjusting the size of the ring opening;

a wedge having a taper matching the taper of the opening;

means in contact with said wedge and connected to said ring for securing said wedge in said opening, the surface of said wedge positioned flush with the outer diameter of said ring; and annular side plates secured to either axial side of said ring, said side plates extending radially outwardly from said ring, said side plates defining slots creating a passageway from the exterior of said side plates to the interior.

2. The coil form of claim 1 wherein said ring has a circumferentially extending rabbet on the outside diameter of both edges, said annular side plates situated in said rabbets.

3. The coil form of claim 1 wherein one of said annular side plates defines a tangential groove extending outer diameter of the ring to the periphery of the side plate.

4. The coil form of claim 1 wherein one of said annular side plates includes an insert on the inside surface of the side plate and secured in place from the outside surface of the side plate, said insert flush with the inside surface of the side plate and defining a tangential groove extending from the ring to the periphery of the side plate.

5. The coil form of claim 1 wherein said annular side plates define circumferential grooves, two electrically conductive strips having a recess between them for receiving a superconductive conductor to be wound, clamps to hold the two conductive strips in the grooves.

6. The coil form of claim 1 further comprising electrically conductive strips having two mating halves said halves defining a recess between them for receiving a superconductive conductor to be wound, said annular plates defining a groove in the outer diameter for receiving said electrically conductive strips; and clamp means for holding said electrically conductive strips in said grooves for holding the starting and ending leads of the coil.

* * * * *